US007134586B2

(12) United States Patent
McGee et al.

(10) Patent No.: US 7,134,586 B2
(45) Date of Patent: Nov. 14, 2006

(54) FASTENER DRIVING DEVICE

(75) Inventors: David M McGee, Attleboro, MA (US); Prudencio S Canlas, Jr., North Kingstown, RI (US); Alexander J Calvino, Cranston, RI (US)

(73) Assignee: Stanley Fastening Systems, L.P., East Greenwich, RI (US)

( * ) Notice: Subject to any disclaimer, the term of this patent is extended or adjusted under 35 U.S.C. 154(b) by 0 days.

(21) Appl. No.: 10/879,700

(22) Filed: Jun. 30, 2004

(65) Prior Publication Data

US 2006/0000863 A1 Jan. 5, 2006

(51) Int. Cl.
*B25C 1/04* (2006.01)

(52) U.S. Cl. ..... 227/125; 227/120; 227/127

(58) Field of Classification Search ..... 227/109, 227/119, 120, 121, 123, 125, 126, 127
See application file for complete search history.

(56) References Cited

U.S. PATENT DOCUMENTS

| | | | | |
|---|---|---|---|---|
| 3,858,781 | A * | 1/1975 | Obergfell et al. | 227/8 |
| 4,197,974 | A | 4/1980 | Morton et al. | |
| 4,463,888 | A | 8/1984 | Geist et al. | |
| 4,549,681 | A * | 10/1985 | Yamamoto et al. | 227/8 |
| 4,597,517 | A | 7/1986 | Wagdy | |
| 5,180,091 | A * | 1/1993 | Ota | 227/8 |
| 5,715,982 | A | 2/1998 | Adachi | |
| 5,803,338 | A | 9/1998 | Singer et al. | |
| 5,816,468 | A | 10/1998 | Yang | |
| 6,012,622 | A * | 1/2000 | Weinger et al. | 227/8 |
| 6,085,959 | A | 7/2000 | Lee | |
| 6,149,046 | A | 11/2000 | Ho et al. | |
| 6,176,412 | B1 | 1/2001 | Weinger et al. | |
| 6,179,192 | B1 | 1/2001 | Weinger et al. | |
| 6,199,739 | B1 * | 3/2001 | Mukoyama et al. | 227/8 |
| 6,209,770 | B1 | 4/2001 | Perra | |
| 6,592,014 | B1 | 7/2003 | Smolinski | |
| 6,641,022 | B1 * | 11/2003 | Hamano et al. | 227/120 |
| 2003/0121948 | A1 | 7/2003 | Hsien | |

FOREIGN PATENT DOCUMENTS

| | | |
|---|---|---|
| EP | 1 319 476 A2 | 6/2003 |
| EP | 1 319 476 A3 | 4/2004 |

* cited by examiner

*Primary Examiner*—Stephen F. Gerrity
*Assistant Examiner*—Paul Durand
(74) *Attorney, Agent, or Firm*—Pillsbury Winthrop Shaw Pittman LLP

(57) ABSTRACT

A fastener driving device is disclosed. The device includes a fastener depletion sensing system that is constructed and arranged to allow normal operation of a power system contained within the device so long as a supply of fasteners provided by a magazine assembly is such that more than a predetermined number of fasteners are in a feed track and/or a drive track within the device. The fastener depletion sensing system is operable when the predetermined number of fasteners in the feed and/or the drive track is reached to provide a tactile indication to the user that the predetermined number of fasteners has been reached, and permitting the user to either cease further operation following the indication or complete the operation following the indication.

31 Claims, 7 Drawing Sheets

FASTENER DRIVING DEVICE

BACKGROUND OF THE INVENTION

1. Field of the Invention

This application relates to fastener driving devices and more particularly to power operated fastener driving devices having a system for avoiding the problems associated with dry firing.

2. Description of Related Art

Fastener driving devices of the power operated variety can be either pneumatically operated, electrically operated or internal combustion operated. Such devices involve the expenditure of energy at a level which makes it important that each operation constitutes a desired operation for driving a fastener into a workpiece. Much of the available energy is used up in the driving action itself. Consequently, when the device is operated without a fastener in the drive track to be driven, all of the energy normally provided to effect the driving action must be absorbed by the piston hitting the rubber bumper at the end of the drive stroke of the fastener driver. Where a dry firing of this type takes place after each fastener supply provided by the magazine assembly is exhausted, considerable damage and wear to the bumper and intimately related components, as well as damage to the workpiece, can occur. In recognition of this damage possibility, many power operated fastener driving devices have been equipped with some sort of dry firing prevention mechanism.

One example of a dry firing prevention mechanism is disclosed in U.S. Pat. No. 6,012,622. Essentially, dry firing is prevented by sensing fastener depletion and locking out the contact trip assembly in its extended position in response to a depletion signal or movement by the sensor. While arrangements of this type effectively reduce dry fire related component damage, experience has shown that other areas of possible damage are brought into being. The contact trip element when in its extended position is intentionally located so that it is the first structure to be engaged with another structure by the user in normal operation. This location makes it susceptible to being either deliberately or accidentally engaged when the depletion system has locked the contact trip element in its extended position The result is that with lockout depletion sensing systems of the prior art, damage to the contact trip assembly sometimes takes place which would not otherwise take place in the absence of the lockout depletion sensing system. There is still a need for a depletion sensing system which can effectively protect not only components susceptible to dry fire damage, but the contact trip assembly as well.

BRIEF SUMMARY OF THE INVENTION

An aspect of the present invention is to fulfill the need expressed above. The underlying concept of the invention is to fundamentally change the device from one in which dry firing is prevented by locking the contact trip assembly in its extended position to one which enables the contact trip assembly to be moved from its extended position into its actuated position under extreme situations where damage is likely, as for example, when the tool is dropped and lands on the extended contact trip element in such a way as to bend or otherwise damage it.

It is another aspect of the present invention to provide the user with a fastener depletion signal or indication which occurs and can be tactilely sensed during actuation and which enables the user either to cease further operation or complete the operation following the indication depending upon the specific depletion indication by the particular device. That is, if the indication is predetermined to be one indicating when the fasteners have been depleted to zero, the user will want to cease further operation. On the other hand, if the indication is predetermined to be one indicating when the fasteners have been depleted to one or more than one, the user will want to complete the operation following the indication until all of the fasteners have been depleted.

In an embodiment described below, the fastener depletion signal utilized is predetermined to be one indicating zero fasteners are present, thus indicating to the user to cease further operation. Preferably, the preferred zero depletion signal is a yieldable resistance to actuation which is sufficiently great to enable the user to cease further normal actuating movement. However, the resistance will yield and permit actuation of the contact trip assembly under extreme unwanted accidental actuation situations that are beyond normal, such as the dropping of the tool.

In an embodiment, an actuating mechanism which is operable only by first moving the contact trip assembly against the workpiece into its actuating or operative position and thereafter manually moving the trigger into its actuating position. With this sequential only arrangement, when the user feels the zero depletion signal, the user simply does not move the trigger from its inoperative position, but instead takes action to reload the magazine assembly with a new supply of fasteners.

Aspects of the present invention are not limited to sequential only operation but are also applicable to concomitant type actuation as well. In this actuation arrangement, the user must cease further actuating movement of the contact trip assembly in engagement with the workpiece. Here again, the user action called for is a replenishing of the supply of fasteners in the magazine assembly, after either removing the tool from the workpiece and/or removing the finger from the trigger. The user readily understands that sensing the resistance of the fastener depletion signal does not mean to push harder on the tool against the workpiece with the trigger squeezed, indeed, just the opposite as aforesaid. Thus, in the normal operation of the present invention, dry firing will not take place, thereby protecting components susceptible to dry firing damage, while at the same time protecting the contact trip assembly from damage of the type experienced with tools having the prior art lockout arrangements.

In accordance with aspects of the present invention, the fulfillment of the expressed need is achieved by providing a fastener driving device. The device includes a portable housing assembly that defines a fastener drive track, a fastener driver that is movably mounted in the drive track, a magazine assembly that is constructed and arranged to feed successive leading fasteners from a supply of fasteners contained therein along a feed track and into the drive track, and a power operated system that is constructed and arranged to be actuated so as to move the fastener driver through successive operative cycles. Each cycle includes a drive stroke in which a fastener in the drive track is driven into a workpiece, and a return stroke. The device also includes an actuating mechanism that includes a contact trip assembly and a trigger assembly that is constructed and arranged to actuate the power operated system in response to a predetermined cooperative movement between the contact trip assembly and the trigger assembly, and a fastener depletion sensing system that is constructed and arranged to allow normal operation of the power system so long as the supply of fasteners provided by the magazine assembly is such that more than a predetermined number of fasteners are in the feed track and/or the drive track. The fastener depletion sensing system is operable, when the predetermined number of fasteners in the feed track and/or the drive track is reached, to provide a tactile indication to the user that the predetermined number of fasteners has been reached, and permitting the user to either cease further operation following the indication or complete the operation following the indication.

According to an aspect, a fastener driving device is provided. The fastener driving device includes a portable housing assembly that defines a fastener drive track, a fastener driver that is movably mounted in the drive track, a magazine assembly that is constructed and arranged to feed successive leading fasteners from a supply of fasteners contained therein along a feed track and into the drive track, and a power operated system that is constructed and arranged to be actuated so as to move the fastener driver through successive operative cycles. Each cycle includes a drive stroke wherein a fastener in the drive track is driven into a workpiece and a return stroke. The device also includes an actuating mechanism that includes a contact trip assembly and a trigger assembly constructed and arranged to actuate the power operated system in response to a predetermined cooperative movement between the contact trip assembly and the trigger assembly. The contact trip assembly is constructed and arranged to be moveable between an inoperative position and an operative position with an application of a force thereon. The device further includes a fastener depletion sensing system that includes at least two surfaces that engage one another to prevent actuation of the power operated system upon a predetermined amount of fasteners in the feed track and/or the drive track being reached. A further application of force to the contact trip assembly after the indication allows the surfaces to slide past one another so that the contact trip assembly is able to move to the operative position, thereby protecting the contact trip assembly upon the further application of force.

It is another aspect to provide a method for driving a fastener with a fastener driving device. The method includes actuating a power operated system that moves a fastener driver through successive operative cycles. Each cycle includes a drive stroke that drives one of a supply of fasteners and a return stroke. The actuating includes pressing a contact trip assembly to a workpiece so as to move the contact trip assembly from an inoperative position to an operative position, and moving a trigger assembly from an inoperative position to an operative position. The method also includes sensing that the supply of fasteners is at or below a predetermined number of fasteners, and determining whether to continue actuating the power operated system by applying an additional force to the contact trip assembly or to reload the supply of fasteners prior to continuing actuating the power operated system.

These and other aspects of the invention will become apparent from the following detailed description when taken in conjunction with the accompanying drawings, which are part of this disclosure and which illustrate, by way of example, the principles of this invention.

BRIEF DESCRIPTION OF THE DRAWINGS

Features of the invention are shown in the drawings, in which like reference numerals designate like elements. The drawings form part of this original disclosure, in which.

DETAILED DESCRIPTION OF THE INVENTION

Figure 1:
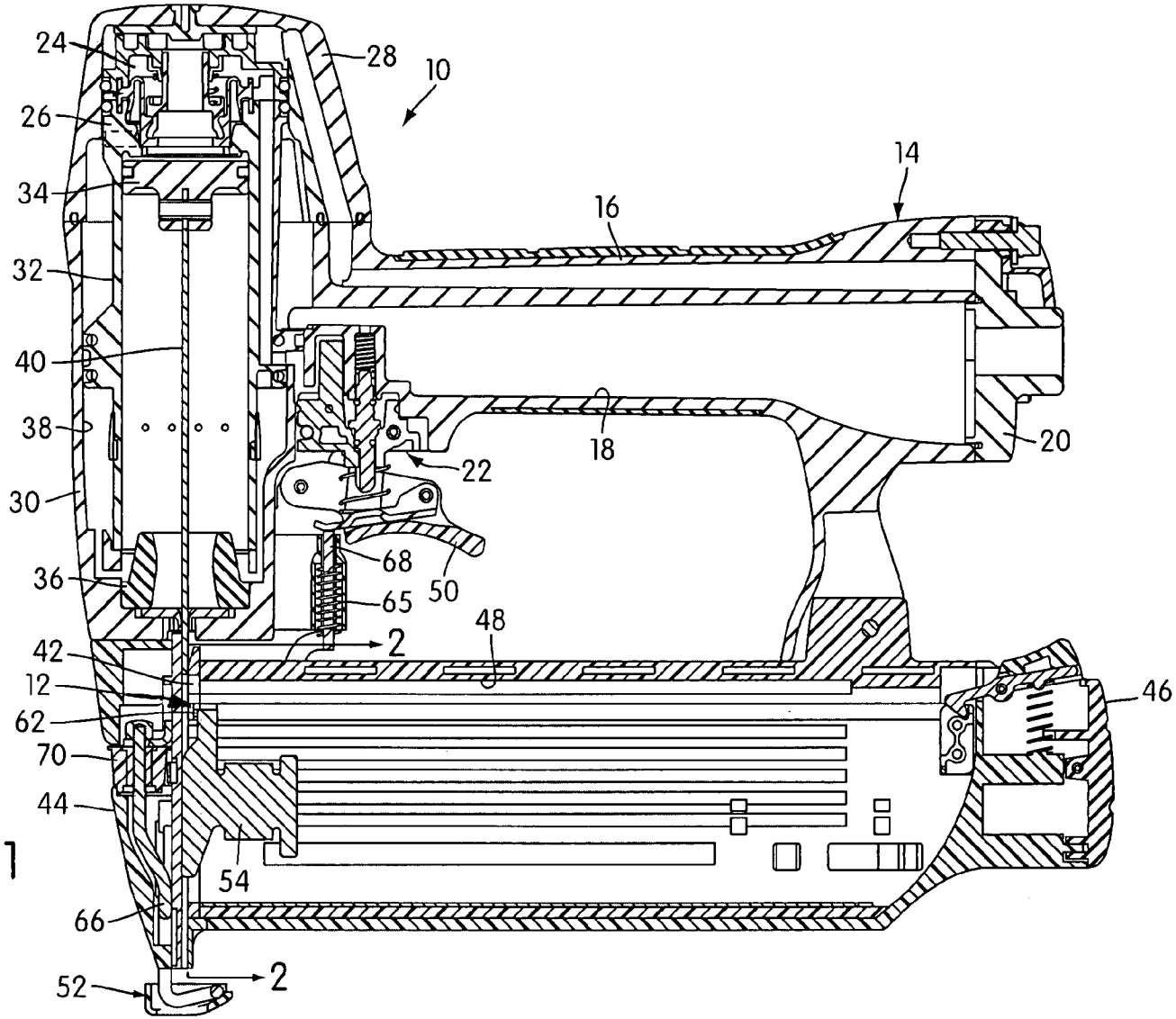
FIG. 1 is a vertical sectional view of a fastener driving device embodying the principles of the present invention.
Figure 2:
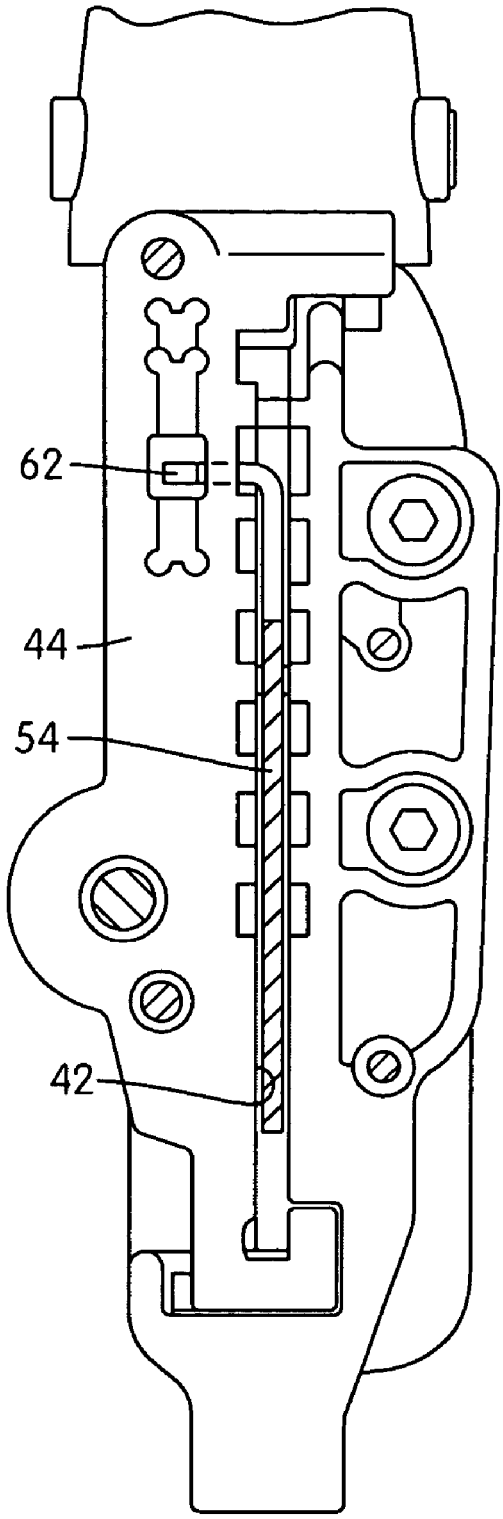
FIG. 2 is an enlarged sectional view taken along the line 2—2 of FIG. 1.

Referring now more particularly to the drawings, there is shown in FIG. 1 a fastener driving device, generally indicated at 10, embodying the principles of the present invention. The invention is particularly concerned with the construction and operation of a fastener depletion sensing system, generally indicated at 12 and shown in greater detail in FIGS. 4–7, embodied in the fastener driving device 10. The fastener driving device 10 itself may be of any known configuration. As shown, the fastener driving device 10 is power operated. Such power operation can be of any well known type such as electrical, internal combustion or pneumatic. The fastener driving device 10 as shown in FIG. 1 is a typical pneumatically powered unit.

Specifically, the pneumatically powered fastener driving device 10 shown in FIG. 1 includes a portable housing or frame assembly, generally indicated at 14. The portable housing assembly 14 includes a handle section 16 which is hollow so as to define a pneumatic reservoir 18. A fitting 20 leads to the reservoir 18 enabling a source of air under pressure (not shown) to be communicated with the reservoir 18.

The reservoir 18 communicates with a manually operable trigger valve assembly 22, which controls the communication of the reservoir to a pilot pressure chamber 24 of a main valve assembly 26. The main valve assembly 26 is housed within a cap assembly 28, fixed to the top of a main housing section 30, that is integral with and extending generally perpendicular to the handle section 16, both of which form parts of the portable housing assembly 14.

Mounted within the main housing section 30 is a cylinder 32, an upper end of which cooperates with the main valve assembly 26 to enable the main valve assembly 26 to function in the usual fashion when in an inoperative position, wherein the pilot pressure chamber 24, under the control of trigger valve assembly 22 in its inoperative position, is communicated with the reservoir 18. When in its inoperative position, the main valve assembly 26 also functions to communicate the open upper end of the cylinder 32 with atmosphere through the cap assembly 28.

When the trigger valve assembly 22 is manually moved from its inoperative position into an operative position, the pilot pressure chamber 24 is shut off from communication with the reservoir 18 and communicated with atmosphere. The pressure from the reservoir 18 then acts upon the main valve assembly 26 to move it from its inoperative position into an operative position. In its operative position, the main valve assembly 26 functions to shut off the communication of the open upper end of the cylinder 32 with the atmosphere and to allow full peripheral communication thereof with the reservoir 18.

Communication of the reservoir 18 with the open upper end of the cylinder 32 serves to drive a piston 34 slidably mounted within the cylinder 32 through a fastener drive stroke which is completed when the piston 34 engages a shock absorbing bumper 36 mounted in the main housing section 30 below the lower end of the cylinder 32 which is fixed therein.

The drive stroke of the piston 34 constitutes one stroke of a two stroke cycle of movement that the piston 34 undergoes on a successive basis in accordance with the manual actuating movement of the trigger valve assembly 22. The other stroke of the piston 34, which constitutes a return stroke, is accomplished by a suitable return system 38. The return system can be of any known type. As shown, the return system 38 is of the air plenum chamber type.

The drive stroke of the piston 34 serves to move a fastener driver 40 connected therewith through a drive stroke within a drive track 42 formed within a nose piece assembly 44 fixed below the lower end of the main housing section 30 and forming a part of the portable housing assembly 14. The drive stroke of the fastener driver 40 serves to drive a leading fastener from a supply of fasteners contained within a fastener magazine assembly 46 which has been laterally moved into the drive track 42 along a feed track 48 defined by the magazine assembly 46.

The magazine assembly 46, which is fixed to the nose piece assembly 44 and extends below and is fixed to the handle section 16, can be of any known type. The magazine assembly 46, as shown, is a conventional side loader capable of handling fasteners in a stick formation supply, as shown, or a coil formation supply of any well known configuration.

The trigger valve assembly 22 is manually actuated by an actuating mechanism which includes a trigger assembly 50 and a contact trip assembly 52. A complete actuation movement serves to move the trigger valve assembly 22 from its inoperative position into its operative position by the coordinated movement of the trigger assembly 50 and contact trip assembly 52, both of which may be of any conventional construction so as to require any known coordination to effect operation. In the illustrated embodiment, actuation requires a specific sequential movement. That is, the cooperation between the trigger assembly 50 and the contact trip assembly 52 is such that the trigger valve assembly 22 will be moved from its inoperative position into its operative position only when the contact trip assembly 52 is first moved against the workpiece and into its operative position and thereafter the trigger assembly 50 is manually moved into its operative position.

In the broadest aspects of the present invention, the device 10 can be adapted to handle any fastener configuration. However, in the embodiment shown, the feed track 48 is configured to receive therein a supply of finishing nail fasteners in stick formation. The magazine assembly 46 includes a pusher 54, the illustrated embodiment of which is shown as a sheet metal structure having a width slightly greater than the diameter of the finishing nails. The pusher 54 is slidably mounted in the feed track 48 and is spring-biased to move in a direction toward the drive track 42. As best shown in FIGS. 4–7, the sheet metal structure of the pusher 54 includes a pair of laterally spaced extending flange portions 56, each of which receives a spring fitting 58. A spring 60 is connected between the normally fixed movable subassembly of the magazine assembly 46 and each spring fitting 58.

In accordance with an embodiment of the present invention, the fastener depletion sensing system 12 includes a fastener depletion sensor 62 constructed and arranged to provide a fastener depletion signal in response to the depletion of fasteners in the fastener supply provided by the magazine assembly 46 such that only a predetermined number of fasteners remain in the feed track 48 and/or the drive track 42. Preferably, the predetermined number is be based on the combined number of fasteners that remain in the feed track 48 and the drive track 42. It is understood that the predetermined number may be any number of fasteners. Preferably, the predetermined number is within the range of zero to three inclusive. In the illustrated embodiment, the predetermined number is zero. Preferably, the sensor 62 is a movable signaling member constructed and arranged to provide a fastener depletion signal in the form of a sensing movement thereof in response to the number of fasteners in the feed track 48 reaching zero. In the embodiment shown, the sensor 62 is in the form of a laterally extending flange-like element formed integrally as part of the sheet metal structure of the pusher 54.

The fastener depleting sensing system 12 also includes a yieldable assembly, generally indicated at 64, operatively associated with the contact trip assembly 52 of the actuating mechanism and the fastener depletion sensor 62. The yieldable assembly 64 is constructed and arranged to allow normal operation of the contact trip assembly 52 so long as the supply of fasteners contained in the feed track 48 is greater than zero and to provide a signal in the form of a predetermined yielding resistance to the actuation of the contact trip assembly 52 when a fastener depletion signal has been provided by the fastener depletion sensor 62.

The contact trip assembly 52, in addition to its biasing spring, which is shown at 65 in FIG. 1, may be of non-adjustable one-piece construction, however, as shown, the contact trip assembly 52 provides for adjustment of the depth of penetration of the fastener into the workpiece during the drive stroke of the fastener driver 40. As best shown in FIG. 1, the contact trip assembly 52 includes a workpiece engaging contact trip subassembly or member 66, a trigger assembly engaging contact trip subassembly or member 68 and an adjustable connection 70 between the two contact trip members 66 and 68.

The operation of the adjustable connection is entirely conventional, it being noted, however, that it is greatly preferred to have the yieldable assembly 64 cooperate with the trigger assembly engaging contact trip member 68 since its position remains the same after adjustment, whereas the workpiece engaging contact trip member 66 assumes a different position after adjustment requiring accommodation.

Figure 3:
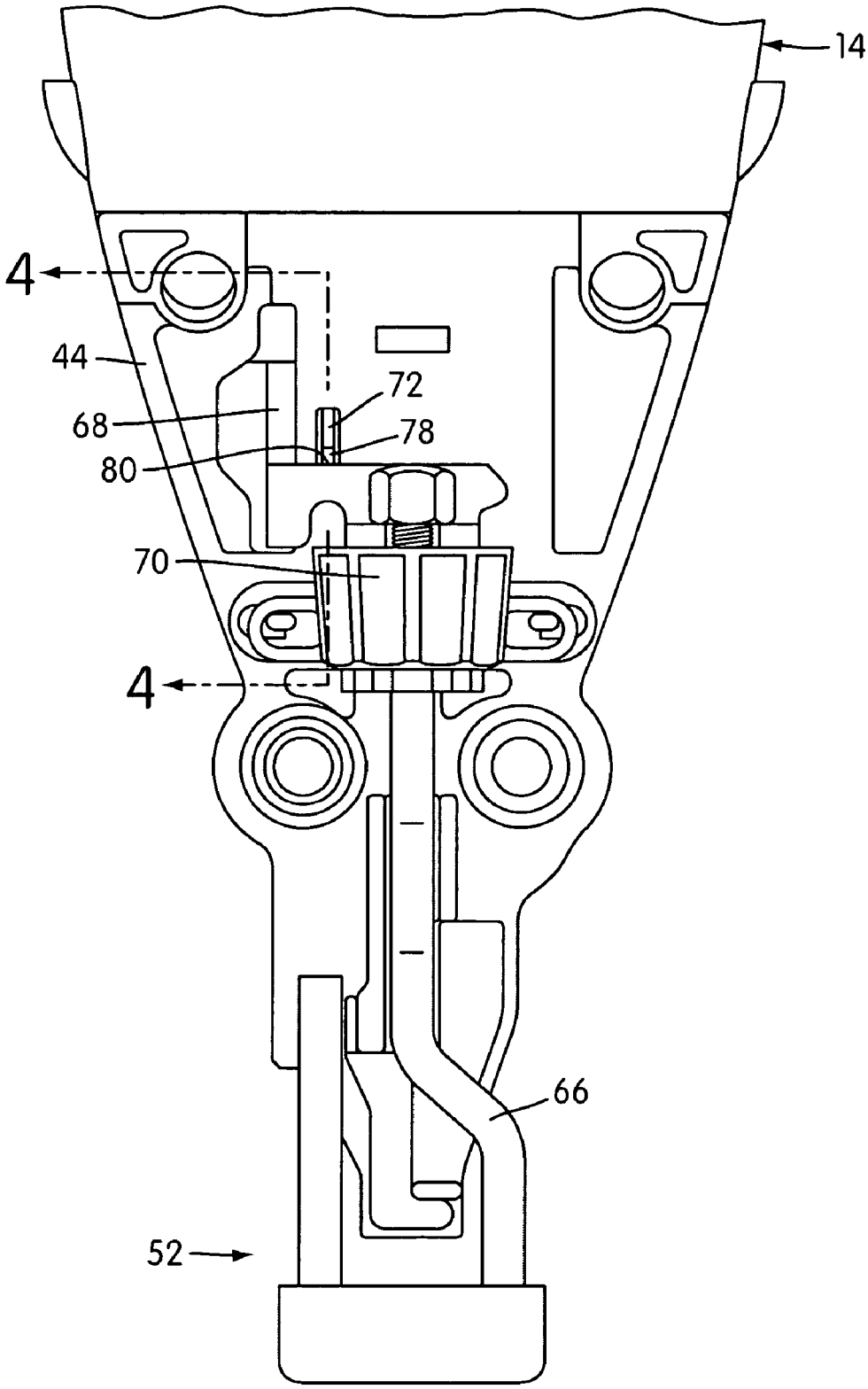
FIG. 3 is a fragmentary end elevational view looking at the nosepiece of the device.
Figure 4:
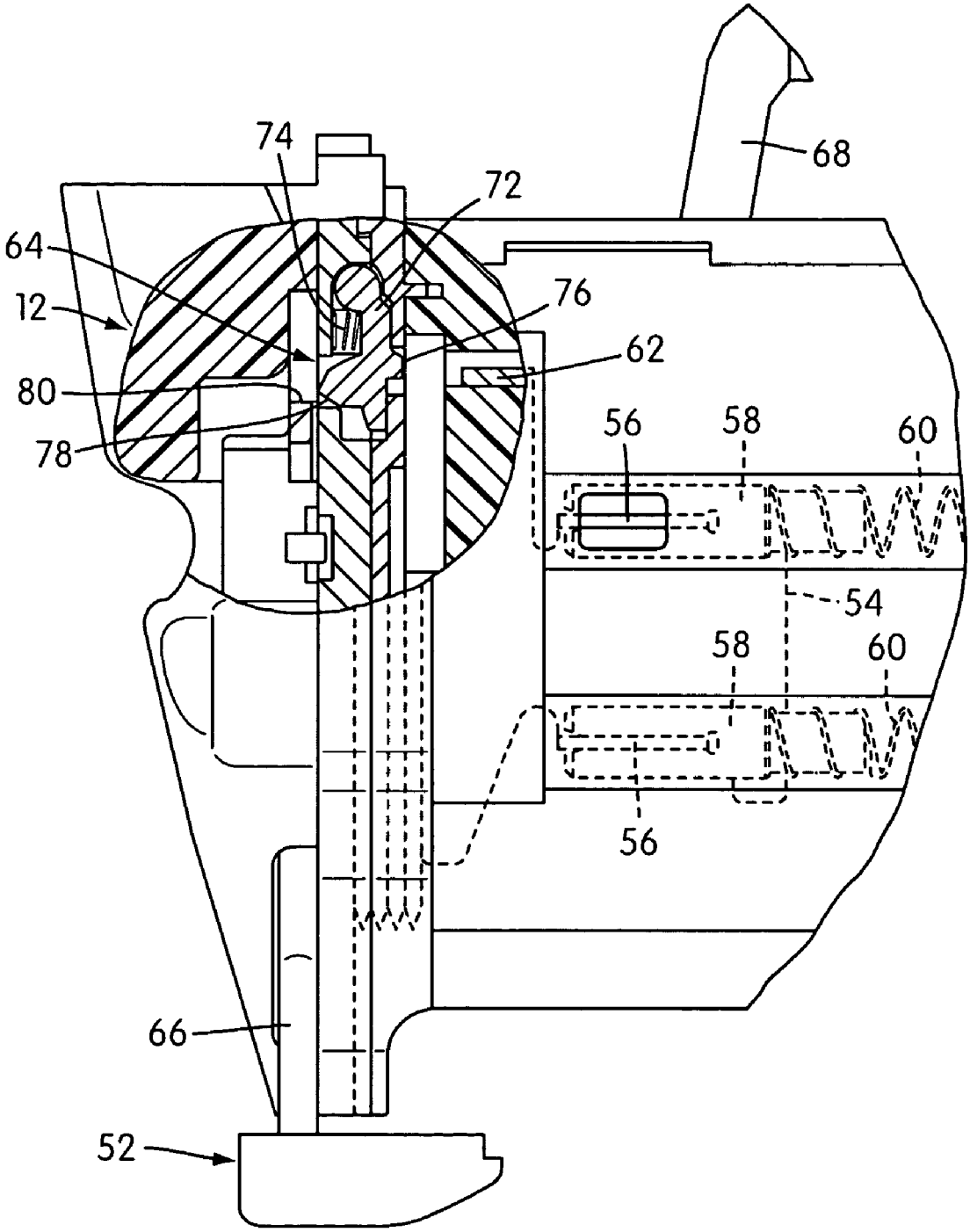
FIG. 4 is a side elevational view partly in section taken along the line 4—4 of FIG. 3 with a centrally located pusher and a spring biasing connection thereof being shown in broken lines; the parts in section being shown in the position assumed just prior to fastener depletion preparatory to firing.
Figure 5:
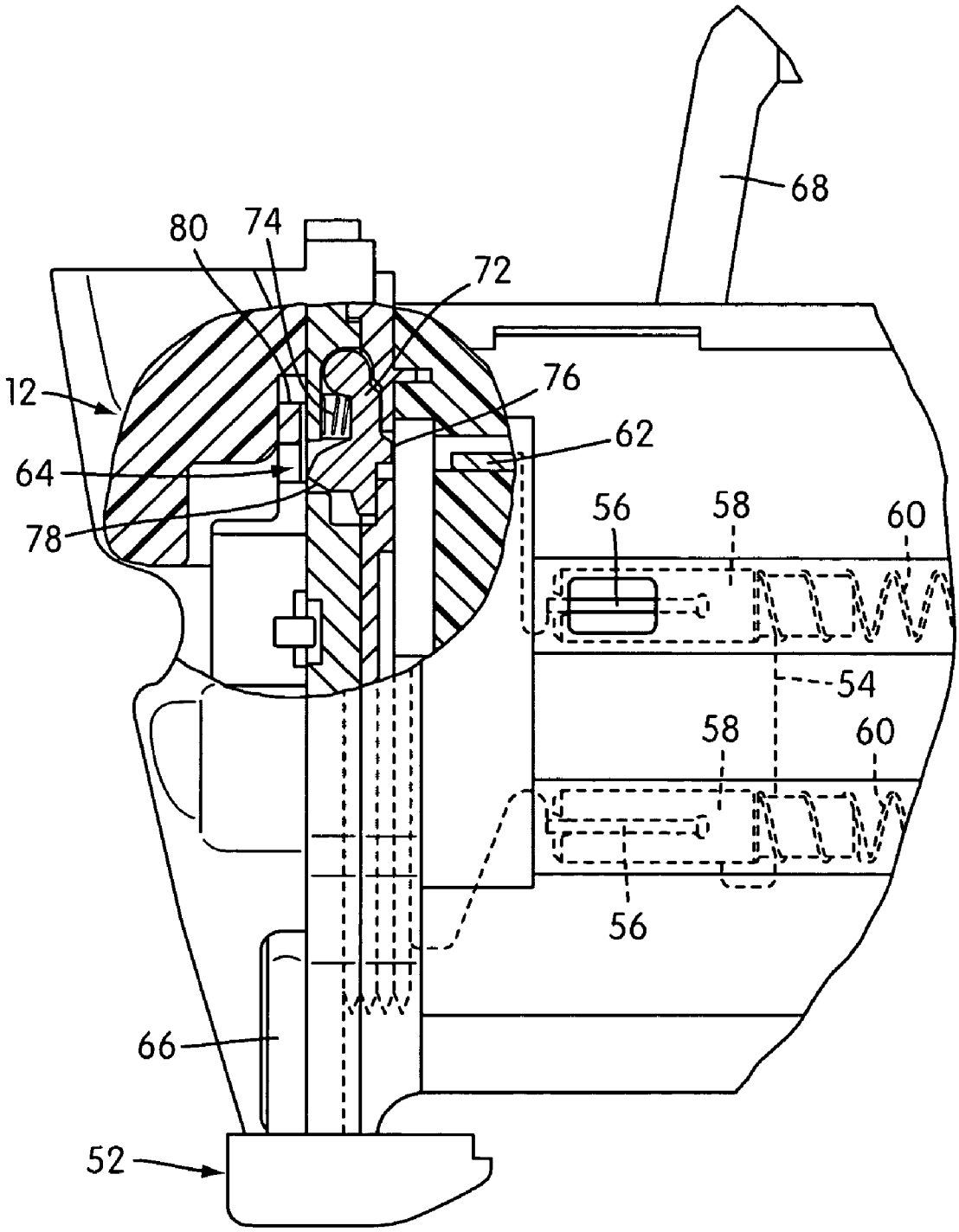
FIG. 5 is a view similar to FIG. 4 showing the position of the parts after actuating movement of a contact trip assembly.
Figure 6:
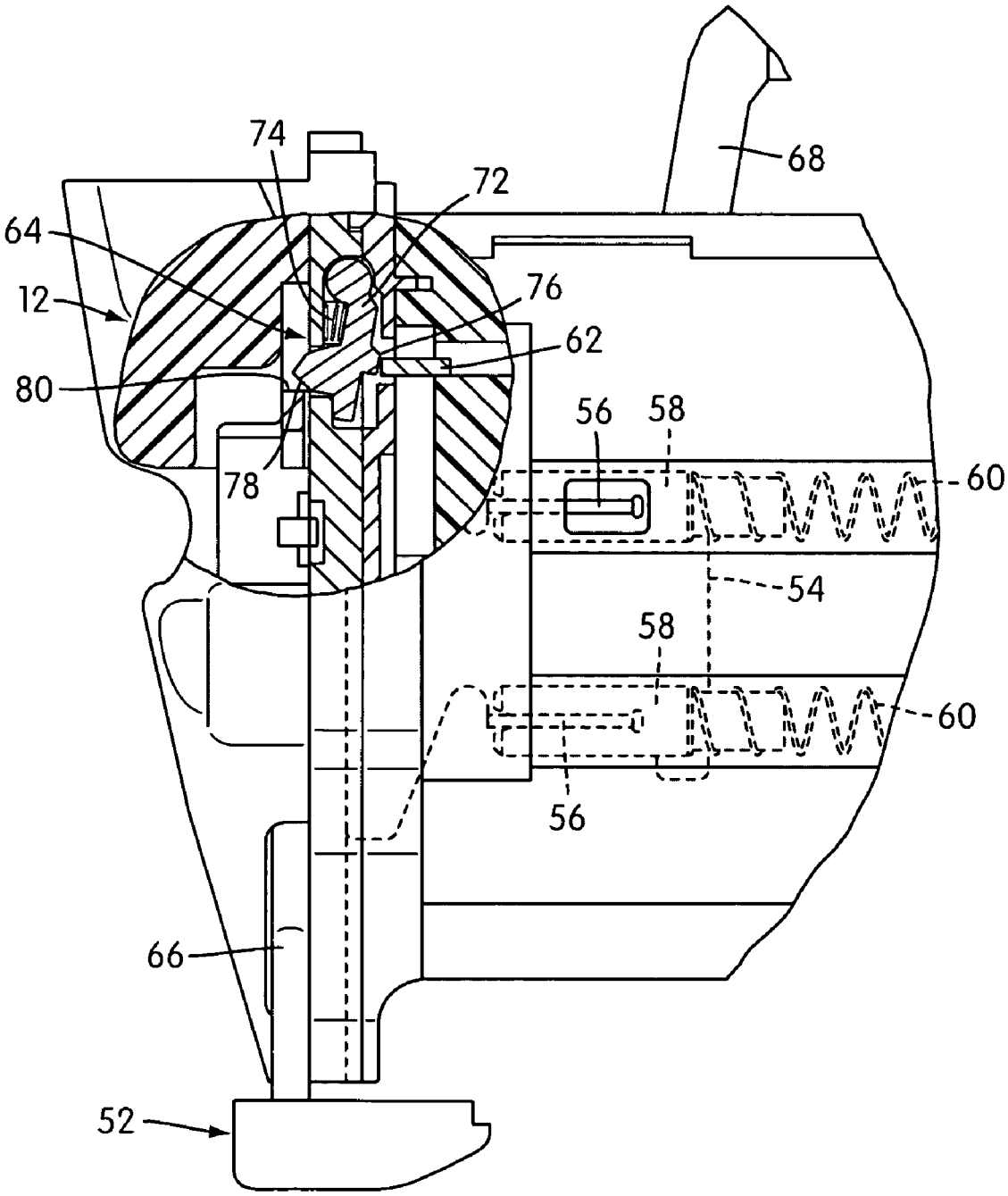
FIG. 6 is a view similar to FIG. 4 showing the position of the parts after a fastener depletion signal has occurred.

The preferred configuration of the yieldable assembly 64 is best shown in FIGS. 4–7, and includes a pivoted yieldable blocking member 72. As best shown in FIG. 3, the yieldable blocking member 72 is pivotally mounted in the nosepiece assembly 44 at a position laterally spaced from the centrally located fastener drive track 42. The pivotal mounting of the yieldable blocking member 72 enables it to be spring-biased, as by a spring 74, into a normal operating position and to be moved against the bias of spring 74 into a blocking position, which is shown in FIG. 6.

As best shown in FIGS. 4 and 5, the yieldable blocking member 72, when in its normal operative position, is disposed in the path of movement of the sensor 62 so as to be engaged and moved thereby when the sensor 62 is moved through a sensing signal, as shown in FIG. 6. The yieldable blocking member 72 includes a rearwardly facing intermediate surface 76 engageable by the sensor 62 and a free end surface 78 engageable by the contact trip member 68. Since the intermediate surface 76 is closer to the pivotal axis of the yieldable blocking member 72, than the free end surface 78, the movement imparted to the intermediate surface 76 by the sensor 62 results in a greater amount of movement of the free end surface 78. This action is desirable in situations such as presented by the described embodiment where the signaling movement is relatively small due to the nature of the fasteners.

OPERATION

FIG. 4 illustrates the condition of the device 10 following the completion of an operating cycle in which there are still remaining a plurality of fasteners greater than the predetermined number (zero) to which the fastener depletion signal is predetermined to be responsive.

The position of the parts in FIG. 4 is the position which the parts assume after the cycle of operation is completed and a new cycle is to begin. In this regard, it will be noted that the existence of the nails within the feed track 48 serves to space the sensor 62 from the yieldable blocking member 72. This relationship is shown in FIG. 4 and it will be noted that the yieldable blocking member 72 is maintained in its normal operative position by the spring 74. It will also be noted that the surface 80 of the contact trip member 68 can move upwardly, as shown in FIG. 5, without any blockage when the yieldable blocking member 72 is in the position shown in FIG. 4. Consequently, in this condition, normal operation of the device 10 can be accomplished in the usual way by the coordinated movement between the contact trip assembly 52 engaging the workpiece and the manual actuation of the trigger assembly 50. This actuating movement will result in the device 10 going through its normal operating cycle.

It will be noted that during the return stroke of the fastener driver 40, as the lower end portion moves upwardly out of the drive track 42, the pusher 54 is operable under the actuation of springs 60 to move all of the remaining fasteners in the feed track 48 forwardly so that the leading fastener moves into the drive track 42. The device is then ready for another cycle of operation. When the last fastener has been moved from the feed track 48 into the drive track 42 during a preceding operative cycle, the sensor 62 moves forward into engagement with the surface 76 of the yieldable blocking member 72. Now, when the last nail in the drive track 42 is driven in the next cycle and the fastener driver 40 is withdrawn during the return stroke, the pusher 54 is biased by springs 60 to enter the drive track 42 carrying with it the sensor 62 in engagement with the surface 76 of the yieldable blocking member 72.

The pusher springs 60 and the yieldable blocking member spring 74 form a counterbalanced spring system enabling the springs 60 to overcome the bias of the spring 74 so that as the pusher 54 is moved into the drive track 42, the sensor 62 will move the yieldable blocking member 72 about its pivotal axis against the bias of spring 74, in a clockwise direction as viewed in FIG. 4, thus moving the blocking surface 78 into overlying relation to the surface 80 of the contact trip member 68. This condition is illustrated in FIG. 6. Now, if the user should attempt to engage the contact trip assembly 52 with a workpiece as a first actuation movement, the contact trip member 68 will move into engagement with the surface 78 of the yieldable blocking member 72, thus creating a resistance to further movement of the contact trip assembly 52; the resistance being readily felt by the user. This indication to the user tells the user that the fasteners are depleted and that the actuation movement should not be completed. Instead of another actuation, the user should open the magazine assembly 46 to replenish the supply of fasteners provided.

Since the preferred actuation arrangement involves an actuating mechanism which is operable only be first moving the contact trip assembly 52 against the workpiece into its actuating or operative position and thereafter manually moving the trigger assembly 50 into its actuating position, when the user feels the zero depletion signal, the user simply does not move the trigger assembly 50 from its inoperative position. Instead, the user takes action to reload the magazine assembly 46 with a new supply of fasteners. The principles of the present invention are not limited to sequential only operation, but are also applicable to concomitant type actuation as well. In this type of actuation, the user must cease further actuation movement of the contact trip assembly 50 in engagement with the workpiece. Here again, the user action called for is a replenishing of the supply of fasteners in the magazine assembly 46 after either removing the tool 10 from the workpiece and/or removing the finger from the trigger assembly 50. The user readily understands that sensing the resistance of the fastener depletion signal does not mean to push harder on the tool 10 against the workpiece with the trigger assembly 50 squeezed. Indeed, just the opposite action is called for as aforesaid.

If for any reason the user puts the device 10 down in the condition shown in FIG. 6, before fastener resupply, and it should accidentally drop so that the device hits the floor contact trip element first, the force of the unwanted impact to the contact trip element 66 will serve to overcome the resistance provided by the interengagement of the surfaces 78 and 80. The workpiece engaging contact trip member 66 may proceed to move upward, thereby protecting the integrity of the contact trip members 66, 68.

Figure 7:
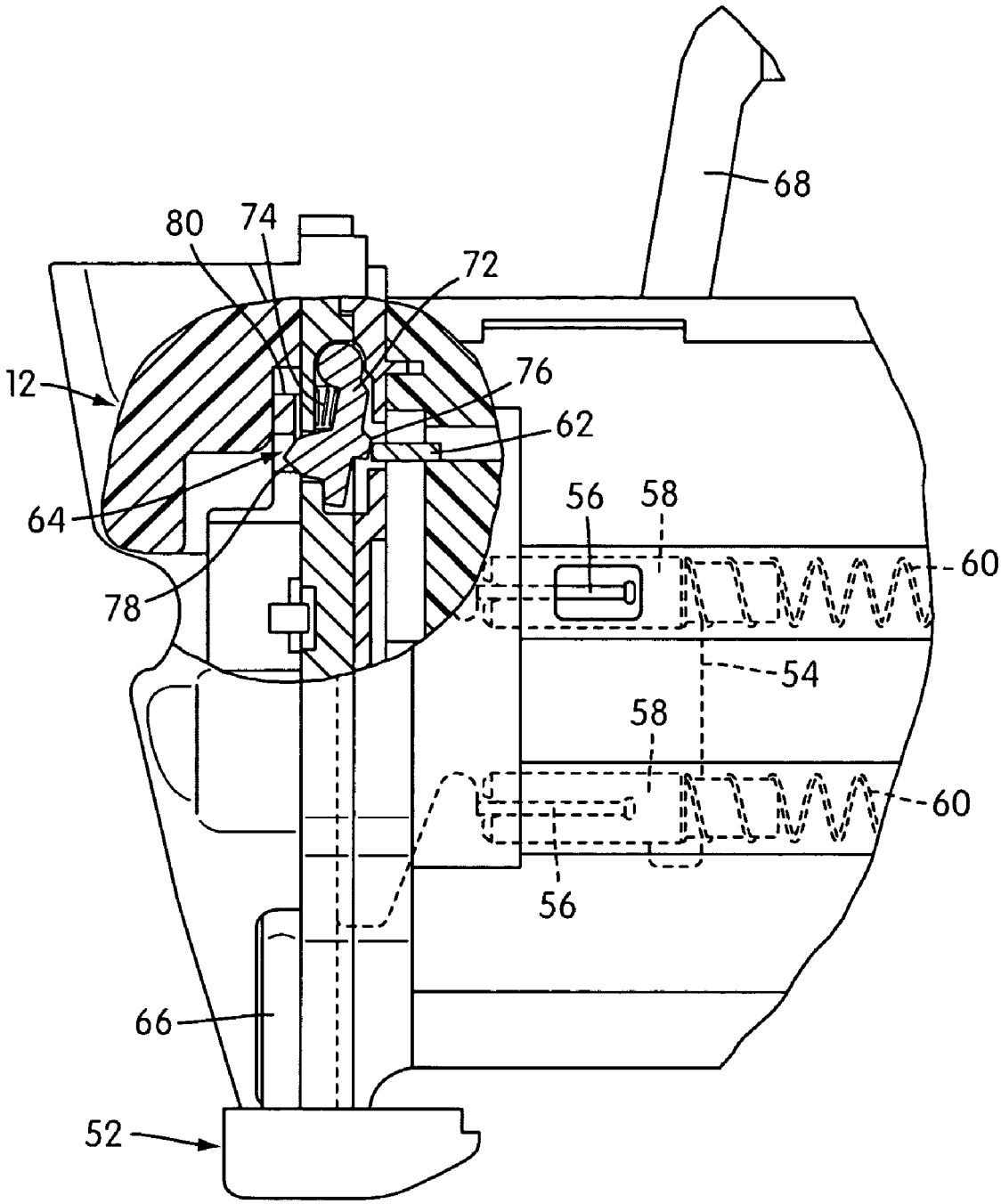
FIG. 7 is a view similar to FIG. 4 showing the position of the parts when an actuating movement of the contact trip assembly has occurred as a result of an unwanted accidental movement thereof.

The movement of the contact trip element 68 beyond the yieldable blocking member 72 is shown in FIG. 7. The mounting of the two members 66, 68 is such so as to permit yielding movement therebetween by virtue of their mounting as well as the shape of the interengaging surfaces 78 and 80. The yieldable blocking member 72 can move in a counterclockwise direction, as viewed in FIG. 4, by moving the sensor 62 together with the pusher 54 against the pusher springs 60. The contact trip member 68 can have a limited amount of forward movement by virtue of the forwardly open slotted arrangement of its connection on opposite sides of the adjusting knob of the connection 70. The actual yielding bypass could be accomplished by the movement of either one or in the case provided, both.

The descriptions above are intended to be illustrative, not limiting. Thus, it will be apparent to one skilled in the art that modifications may be made to the invention as described without departing from the scope of the claims set out below.

What is claimed is:

1. A method for driving a fastener with a fastener driving device, the method comprising:

actuating a power operated system that moves a fastener driver through successive operative cycles, each cycle including a drive stroke that drives one of a supply of fasteners and a return stroke, said actuating comprising applying a force to a contact trip assembly by pressing the contract trip assembly against a workpiece so as to move the contact trip assembly from an inoperative position to an operative position, and moving a trigger assembly from an inoperative position to an operative position;

tactilely sensing that the supply of fasteners is at or below a predetermined number of fasteners; and applying an additional force to the contact trip assembly to continuing actuating the power operated system after said sensing.

2. A fastener driving device comprising:

a portable housing assembly having a fastener drive track therein;

a fastener driver movably mounted in said drive track;

a magazine assembly constructed and arranged to feed successive leading fasteners from a supply of fasteners contained therein along a feed track and into said drive track;

a power operated system constructed and arranged to be actuated so as to move said fastener driver through successive operative cycles, each including a drive stroke wherein a fastener in said drive track is driven into a workpiece and a return stroke;

an actuating mechanism including a contact trip assembly and a trigger assembly constructed and arranged to actuate said power operated system in response to a predetermined cooperative movement between said contact trip assembly and said trigger assembly, said contact trip assembly constructed and arranged to be moveable between an inoperative position and an operative position with an application of a force thereon; and a fastener depletion sensing system comprising at least two surfaces that engage one another to prevent actuation of said power operated system upon a predetermined amount of fasteners in the device being reached, said surfaces being arranged to slide past one another so that said contact trip assembly is able to move to the operative position with a further application of force.

3. A fastener driving device according to claim 2, wherein the fastener depletion system comprises a yieldable blocking member that carries one of the surfaces, and wherein the contact trip assembly carries another of the surfaces.

4. A fastener driving device according to claim 3, wherein the surface carried by the yieldable blocking member is inclined relative to the surface carried by the contact trip assembly so that the surface carried by the contact trip assembly slides past the yieldable blocking member upon said further application of force.

5. A fastener driving device according to claim 2, wherein the predetermined amount of fasteners is in the feed track and in the drive track.

6. A fastener driving device comprising:

a fastener driver movably mounted in a drive track;

a magazine assembly constructed and arranged to feed successive leading fasteners from a supply of fasteners contained therein along a feed track and into said drive track;

a power operated system constructed and arranged to be actuated so as to move said fastener driver through successive operative cycles, each cycle including a drive stroke wherein a fastener in said drive track is driven into a workpiece and a return stroke;

an actuating mechanism including a contact trip assembly and a trigger assembly constructed and arranged to actuate said power operated system in response to a predetermined cooperative movement between said contact trip assembly and said trigger assembly, said contact trip assembly constructed and arranged to be moveable between an inoperative position and an operative position with an application of a force thereon; and a fastener depletion sensing system comprising a yieldable blocking member having a first surface configured to engage a second surface on the contact trip assembly when a predetermined amount of fasteners are in the device to prevent the contact trip assembly from being moved from the inoperative position to the operative position with said application of said force, said first and second surfaces being arranged to slide past one another when an additional force is provided to the contact trip assembly so that said contact trip assembly is moved to the operative position.

7. A fastener driving device according to claim 6, wherein said first surface is inclined relative to said second surface, thereby allowing said second surface to slide past said first surface.

8. A fastener driving device comprising:

a portable housing assembly having a fastener drive track therein;

a fastener driver movably mounted in said drive track;

a magazine assembly constructed and arranged to feed successive leading fasteners from a supply of fasteners contained therein along a feed track and into said drive track;

a power operated system constructed and arranged to be actuated so as to move said fastener driver through successive operative cycles, each including a drive stroke wherein a fastener in said drive track is driven into a workpiece and a return stroke;

an actuating mechanism including a contact trip assembly and a trigger assembly constructed and arranged to actuate said power operated system in response to a predetermined cooperative movement between said contact trip assembly and said trigger assembly, said contact trip assembly being constructed and arranged to be moveable between an inoperative position and an operative position with an application of a force thereon; and a fastener depletion sensing system constructed and arranged to allow normal operation of said power operated system so long as the supply of fasteners provided by said magazine assembly is such that more than a predetermined number of fasteners are in said device, to provide a tactile indication to a user of the device that the predetermined number of fasteners has been reached, and to allow movement of said contact trip assembly to the operative position following the indication when an additional application of force is provided to said contact trip assembly.

9. A fastener driving device according to claim 8, wherein said fastener depletion sensing system detects fasteners in the drive track.

10. A fastener driving device according to claim 8, wherein said fastener depletion sensing system detects fasteners in the feed track.

11. A fastener driving device as defined in claim 8, wherein the housing assembly comprises a nosepiece having the fastener drive track therein.

12. A fastener driving device as defined in claim 11, wherein said fastener depletion sensing system includes a fastener depletion sensor constructed and arranged to provide a fastener depletion indication in response to the depletion of fasteners in the fastener supply contained by said magazine assembly such that only the predetermined number of fasteners remain in said device, and a yieldable assembly operatively associated with said contact trip assembly and said fastener depletion sensor, said yieldable assembly constructed and arranged to allow normal operation of said contact trip assembly so long as the supply of fasteners contained in the device is greater than said predetermined number and to provide the tactile indication in the form of a predetermined yielding resistance to the actuation of said contact trip assembly capable of being felt by the user when the fastener depletion indication has been provided by said fastener depletion sensor.

13. A fastener driving device as defined in claim 12, wherein said predetermined number of fasteners is zero and said predetermined resistance is sufficiently great that the user is readily enabled to cease further actuating movement once the indication occurs and is sensed by the user.

14. A fastener driving device as defined in claim 12, wherein said power system includes a cylinder within said housing assembly, a piston connected with said fastener driver movably mounted in said cylinder, a reservoir defined by a handle portion of said housing assembly for containing air under pressure, a pilot pressure operated main valve actable to communicate the reservoir with said cylinder to effect a drive stroke of said fastener driver, and a trigger valve assembly under the control of said actuating mechanism for controlling communication of said reservoir with said main valve assembly to provide pilot pressure to actuate the main valve assembly.

15. A fastener driving device as defined in claim 14, wherein said power system includes a plenum chamber arrangement constructed and arranged to effect said return stroke of said fastener driver following said drive stroke thereof.

16. A fastener driving device as defined in claim 14, wherein said actuating mechanism is operable to control said trigger valve assembly to actuate the main valve assembly only when the contact trip assembly is first moved from the inoperative position thereof into the operative position thereof and thereafter said trigger assembly is moved from an inoperative position thereof into an actuating position thereof.

17. A fastener driving device as defined in claim 12, wherein said fastener depletion sensor comprises a movable signaling member constructed and arranged to provide the fastener depletion indication in the form of a sensing movement thereof in response to the number of fasteners in said device reaching said predetermined number.

18. A fastener driving device as defined in claim 17, wherein said magazine assembly includes a pusher constructed and arranged to move the supply of fasteners along said feed track, said movable signaling member being moved through a sensing movement by said pusher.

19. A fastener driving device as defined in claim 18, wherein said feed track is configured to receive a supply of finishing nail fasteners in stick formation and said pusher is a sheet metal structure slidably mounted in said feed track and spring biased to move in a direction to feed a leading finishing nail fastener of the stick formation into said drive track.

20. A fastener driving device as defined in claim 18, wherein said yieldable assembly includes a yieldable blocking member operatively associated with said contact trip assembly constructed and arranged to be moved into yielding blocking relation with respect to the contact trip assembly in response to the movement of said signaling member through the sensing movement, said yieldable blocking member when in said yieldable blocking relation with respect to the contact trip assembly allowing said contact trip assembly to move from the inoperative position into the operative position only after the predetermined yielding resistance has been overcome.

21. A fastener driving device as defined in claim 20, wherein said feed track is configured to receive a supply of finishing nail fasteners in stick formation and said pusher is a sheet metal structure slidably mounted in said feed track and spring biased to move in a direction to feed a leading finishing nail fastener of the stick formation into said drive track, and wherein said yieldable blocking member is spring biased to move into the normal operating position thereof, the spring bias of said pusher being greater than the spring bias of said yieldable blocking member.

22. A fastener driving device as defined in claim 20, wherein said yieldable blocking member is pivotally mounted on said nosepiece for movement between a normal operating position and a blocking position, the yieldable blocking relation of said yieldable blocking member with respect to said contact trip assembly being established when said yieldable blocking member is in said blocking position and said contact trip assembly is in said inoperative position, said contact trip assembly including a contact trip member having a blocking surface cooperable with a cooperating blocking surface on said yieldable blocking member, said blocking surfaces cooperating in a blocking engagement relation when said yieldable blocking member is in the blocking position thereof and said contact trip member is in said inoperative position, and a yieldable connection between said yieldable blocking and contact trip members is constructed and arranged to allow said blocking surfaces to relatively yieldingly move out of said blocking engagement relation when said predetermined resistance is overcome by the movement of said contact trip assembly into its operative position.

23. A fastener driving device as defined in claim 22, wherein said signaling member is positioned with respect to said yieldable blocking member so as to engage the yieldable blocking member at a position spaced from the pivotal axis thereof a distance less than the distance of the cooperating blocking surface thereof from the pivotal axis thereof enabling the movement of the cooperating blocking surface to be greater than the movement imparted to said yieldable blocking member by said signaling member during the signaling movement thereof.

24. A fastener driving device as defined in claim 22, wherein said contact trip assembly includes a workpiece engaging contact trip member, a trigger assembly engaging contact trip member and an adjustable connection between said contact trip members, enabling the driving depth of the fastener to be adjusted, said trigger assembly engaging contact trip member having the blocking surface thereon which cooperates with the cooperating blocking surface of said yieldable blocking member.

25. A fastener driving device as defined in claim 22, wherein said predetermined number of fasteners is in the range of zero to three inclusive.

26. A fastener driving device as defined in claim 25, wherein said predetermined number of fasteners is zero and said predetermined resistance is sufficiently great that the user is readily enabled to cease further actuating movement once the indication occurs and is sensed by the user.

27. A fastener driving device as defined in claim 26, wherein said feed track is configured to receive a supply of finishing nail fasteners in stick formation and said pusher is a sheet metal structure slidably mounted in said feed track and spring biased to move in a direction to feed a leading finishing nail fastener of the stick formation into said drive track.

28. A fastener driving device as defined in claim 27, wherein said movable signaling member comprises an integral flange-like portion of said sheet metal structure.

29. A fastener driving device as defined in claim 28, wherein said yieldable blocking member is spring-biased to move into the normal operating position thereof, the spring bias of said pusher being greater than the spring bias of said yieldable blocking member.

30. A fastener driving device as defined in claim 29, wherein said signaling member is positioned with respect to said yieldable blocking member so as to engage the yieldable blocking member at a position spaced from the pivotal axis thereof a distance less than a distance of the cooperating blocking surface thereof from the pivotal axis thereof, thereby enabling the movement of the cooperating blocking surface to be greater than the movement imparted to said yieldable blocking member by said signaling member during the signaling movement thereof.

31. A fastener driving device as defined in claim 30, wherein said contact trip assembly includes a workpiece engaging contact trip member, a trigger assembly engaging contact trip member and an adjustable connection between said contact trip members, enabling the driving depth of the fastener to be adjusted, said trigger assembly engaging contact trip member having the blocking surface thereon which cooperates with the cooperating blocking surface of said yieldable blocking member.

* * * * *